United States Patent [19]

Shimbara

[11] Patent Number: 4,508,077

[45] Date of Patent: Apr. 2, 1985

[54] FUEL PUMP CONTROL APPARATUS

[75] Inventor: Hiroyuki Shimbara, Yokohama, Japan

[73] Assignee: Nissan Motor Company, Limited, Yokohama, Japan

[21] Appl. No.: 501,798

[22] Filed: Jun. 7, 1983

[30] Foreign Application Priority Data

Jun. 14, 1982 [JP] Japan ..... 57-102497

[51] Int. Cl.[3] ..... F02D 31/00

[52] U.S. Cl. ..... 123/357; 123/482; 123/488

[58] Field of Search ..... 123/357, 358, 359, 482, 123/488

[56] References Cited

U.S. PATENT DOCUMENTS

| | | | |
|---|---|---|---|
| 3,643,635 | 2/1972 | Milam | 123/357 |
| 3,822,677 | 7/1974 | Reddy | 123/478 |
| 4,048,964 | 9/1977 | Kissel | 123/482 |
| 4,117,815 | 10/1978 | Ikeura | 123/489 |
| 4,134,375 | 1/1979 | Koseki et al. | 123/440 |
| 4,173,952 | 11/1979 | Asano | 123/489 |
| 4,372,266 | 2/1983 | Hiyama et al. | 123/357 |

FOREIGN PATENT DOCUMENTS

| | | | |
|---|---|---|---|
| 5768530 | 10/1980 | Japan . | |
| 32027 | 2/1982 | Japan | 123/357 |

*Primary Examiner*—Magdalen Y. C. Moy

*Attorney, Agent, or Firm*—Lane, Aitken & Kananen

[57] ABSTRACT

The output of a fuel pump of an internal combustion engine is controlled by the duty cycle of its power supply circuit, which is in turn controlled in accordance with engine and fuel conditions. Sensor signals indicative of the engine and fuel conditions are processed to derive a DC voltage level suitable to the conditions. The derived voltage and a triangular voltage signal of fixed frequency and amplitude are compared by a comparator which outputs a train of pulses. The frequency of the pulse train is that of the triangular wave and the duty cycle thereof is determined strictly by the derived voltage. The pulse train from the comparator is amplified to drive the fuel pump.

There may be many different kinds and combinations of engine and/or fuel condition sensors. In addition, sensor signal processing to derive the DC voltage level may take a number of different forms and may include feedback from the fuel pump power supply circuit in order to suppress transient fluctuations.

18 Claims, 12 Drawing Figures

CONSTANT-VOLTAGE SUPPLY UNIT
CPU
I/O
FULL-THROTTLE SWITCH
FUEL TEMP SENSOR
STARTER SWITCH
IDLE SWITCH
TRIANGULAR WAVEFORM GENERATOR
Vcc
Q11
Q12a
Q21
Q13
Q14
Q15
R11
R12
R13
R14
R15
R21
C21
D11
M
+V
12
13
14
15
16
17
18
22
23
24
31
32
33
34
35
38

CONSTANT-VOLTAGE SUPPLY UNIT
CPU
FULL-THROTTLE SWITCH
FUEL TEMP SENSOR
PRECONTROL VOLTAGE VALUE
STARTER SWITCH
IDLE SWITCH
TRIANGULAR WAVEFORM GENERATOR
OP1
OP2
M
+V

FUEL PUMP CONTROL APPARATUS

BACKGROUND OF THE INVENTION

The present invention relates to a fuel pump control apparatus for an internal combustion engine, and more particularly to apparatus for control of the rotational speed of a fuel pump by controlling the supply of electrical power to the fuel pump in accordance with a pulse signal, the duty cycle of which is controlled on the basis of the operating state of the engine.

In a conventional fuel pump control apparatus for an internal combustion engine, for example, as disclosed in unexamined published Japanese Patent Application (Tokkaisho) No. 57-68530, a central processing unit calculates the rotational speed of a fuel pump optimal to the operating state of the engine and outputs a high-level voltage signal, a low-level voltage signal or a high-impedance signal corresponding to the calculated rotational speed via an input/output interface. The engine state is determined on the basis of output signals from operating state sensors, which include an idle switch, a full-throttle switch, and a starter switch. When the output signal from the input/output unit is the high-level voltage signal, a power transistor is turned on and off in accordance with a pulse signal with a fixed duty cycle from a first oscillator to transmit electrical current at a corresponding duty cycle to drive the fuel pump. When the output signal from the input/output unit is a low-level voltage signal, the power transistor is turned on and off in accordance with a pulse signal with a second fixed duty cycle from a second oscillator to transmit electrical current at a corresponding duty cycle to drive the fuel pump. Finally, when the output signal from the input/output unit is a high-impedance signal, neither of the pulse signals from the first and second oscillators causes the power transistor to be turned on and off and the power transistor operates at a 100% duty cycle, thereby supplying maximum electrical current to the fuel pump.

As is obvious from the above, this conventional fuel pump control apparatus requires two different oscillators which output pulse signals with different duty cycles. This requires a correspondingly complicated circuit network, including the necessity of providing two output circuits, one to each oscillator, thereby degrading system reliability and resulting in high manufacturing cost.

SUMMARY OF THE INVENTION

In order to solve the above problems, the present invention provides a fuel pump control apparatus for an internal combustion engine which includes a waveform generator which generates a reference signal having a predetermined period waveform. The duty cycle of the signal is controlled in accordance with the operating state of the engine. The resulting controlled signal controls the electrical current supplied to a fuel pump. The output signal of the generator is preferably a triangular waveform.

The use of a single waveform generator simplifies the structure of the apparatus, makes the apparatus less expensive than the prior art apparatus, and improves the reliability of the fuel pump operation. In addition, if the oscillatory frequency of the waveform generator is selected to be outside the acoustic frequency zone, audio devices equipped in the vehicle will suffer no interference.

Other features and advantages of the present invention will be apparent from the description of preferred embodiments thereof, taken in conjunction with the accompanying drawings.

BRIEF DESCRIPTION OF THE DRAWINGS

In the drawings in which the same reference numerals denote similar elements throughout the drawings.

DETAILED DESCRIPTION OF THE INVENTION

Figure 1:
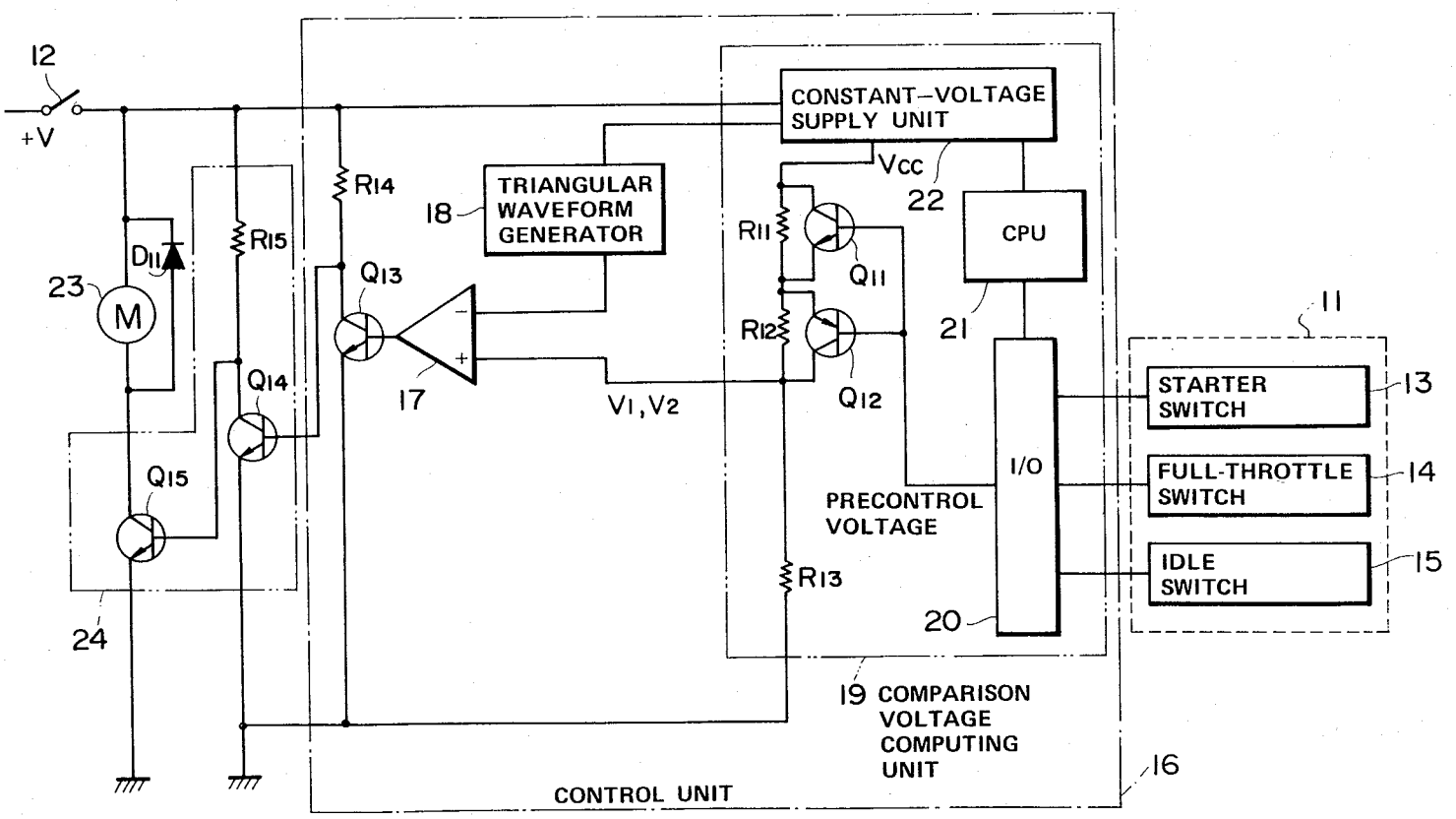
FIG. 1 is a schematic circuit diagram of a preferred embodiment of a fuel pump control apparatus according to the present invention.

Referring to FIG. 1, there is shown a preferred embodiment of a fuel pump control apparatus for an internal combustion engine according to the present invention. In this apparatus, an operating-state detecting unit 11 detects the operating state of the vehicle in which the engine is mounted. Detecting unit 11 includes a starter switch 13 which detects whether an ignition switch 12 is in the starting position and produces an ON signal when switch 12 is in that position, a full-throttle switch 14 which detects whether the engine is running in the full-throttle condition (for example, whether the throttle valve is in a fully-open position, or whether the intake manifold vacuum is lower than a predetermined value) and outputs an ON signal when the engine is in the full-throttle condition, and an idle switch 15 which detects whether the engine is idling (for example, whether the throtte valve is in the idle-open position, or whether intake manifold vacuum is higher than a predetermined value) and produces an ON signal when the engine is idling.

The respective output signals from detecting unit 11 are inputted to a control unit 16 which includes a comparator 17, a triangular waveform generator 18 which outputs a triangular waveform or reference signal, the frequency of which is outside the acoustical-frequency range (for example higher than 20 KHz), to the minus-input terminal of comparator 17, and a comparison voltage computing unit 19 which computes a comparison voltage on the basis of the output signals from detecting unit 11 and outputs the comparison voltage to the plus-input terminal of comparator 17.

Computing unit 19 includes an input/output (I/O) unit 20, a central processing unit (CPU) 21, a constant-voltage supply unit 22, resistors $R_{11}$, $R_{12}$ and $R_{13}$ connected in series between unit 22 and ground, and a pair of transistors $Q_{11}$ and $Q_{12}$ which are capable of shortcircuiting $R_{11}$ and $R_{12}$, respectively. When detecting unit 11 outputs signals to I/O 20, CPU 21 calculates the rotational speed of a fuel pump 23 optimal to the sensed operating state on the basis of the signals and outputs a precontrol voltage value signal, as shown in Table I from I/O 20.

TABLE I

| MODE | IDLE SWITCH | FULL-THROTTLE SWITCH | STARTER SWITCH | I/O output |
|---|---|---|---|---|
| I-1 | OFF | OFF | ON | HIGH IMPEDANCE |
| I-2 | OFF | OFF | OFF | LOW-LEVEL VOLTAGE |
| I-3 | ON | OFF | OFF | HIGH LEVEL VOLTAGE |
| I-4 | OFF | ON | OFF | HIGH IMPEDANCE |

In Table I, MODE (I-1) designates the engine start-up, MODE (I-2) designates normal operation (excluding idling and full-throttle operation), MODE (I-3) designates idling operation, and MODE (I-4) designates full-throttle operation. The ON and OFF states of the transistors in accordance with the signals from I/O 20 control the magnitude of a voltage applied to the plus-input terminal of comparator 17. In more detail, in MODE (I-1), the output of I/O 20 is a high-impedance signal so that transistors $Q_{11}$, $Q_{12}$ are both ON, thereby shortcircuiting resistors $R_{11}$ and $R_{12}$, and that the voltage $V_1$ applied to the plus-input terminal of comparator 17 is Vcc, that is, the output voltage of constant-voltage supply unit 22. In MODE (I-2), the output of I/O 20 is a low-level voltage so that transistors $Q_{11}$ and $Q_{12}$ are off and on, respectively, and the voltage $V_2$ applied to comparator 17 is $Vcc \cdot R_{13}/(R_{11}+R_{13})$. In MODE (I-3), the output of I/O 20 is a high-level voltage so that the voltage $V_3$ applied to comparator 17 is $Vcc \cdot R_{13}/(R_{12}+R_{13})$. In MODE (I-4), the output of I/O 20 is a high impedance so that the voltage $V_4$ applied to comparator 17 equals $V_1=Vcc$. Resistors $R_{11}$ and $R_{12}$ are selected such that the former is greater in resistance than the latter so that $V_2$ is greater than $V_3$.

Figure 2:
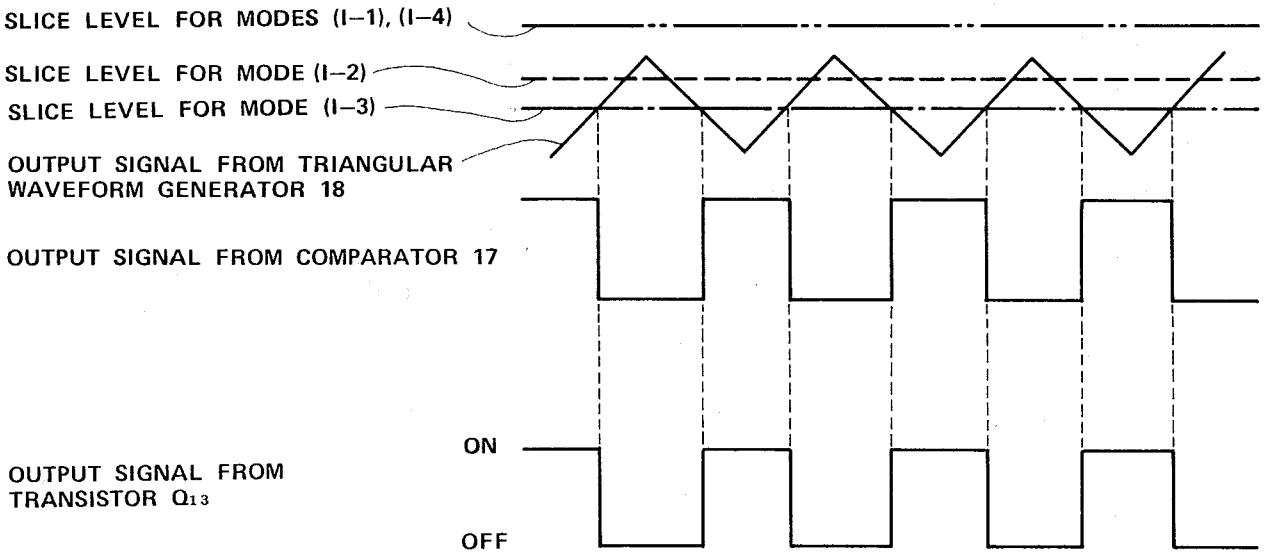
FIG. 2 is a timing chart of the input and output signals of a comparator and the output signal of a transistor associated therewith, incorporated in the apparatus of FIG. 1.

Changes in the comparison voltage applied to the plus-input terminal of comparator 17 causes the cross-over voltage of comparator 17 to change, as shown in FIG. 2, which in turn affects the width of a rectangular pulse outputted at the frequency of the triangular wave to transistor $Q_{13}$. For example, in MODE (I-3), comparator 17 outputs a pulse signal with a duty cycle of X%. In MODE (I-2), $V_2$ is greater than $V_3$, so that comparator 17 outputs a pulse signal of width greater than in MODE (I-3), i.e. with a duty cycle Y% greater than X%. In MODEs (I-1) and (I-4), the comparison voltage is higher than the maximum voltage of the triangular waveform signal so that comparator 17 outputs a constant-voltage signal. In summary, comparator 17 outputs a pulse signal with a duty cycle which is controlled in accordance with the triangular waveform voltage and the comparison voltage.

The duty cycle in MODE (I-3) is smaller than that in MODE (I-2) which in turn is smaller than that (100%) in MODE (I-1) or (I-4). When the output signal of comparator 17 is high, transistor $Q_{13}$ is ON and when the output signal comparator 17 is low, transistor $Q_{13}$ is OFF. This switching of transistor $Q_{13}$ causes a fuel pump drive circuit 24 to control the supply of electrical current to fuel pump 23. In control unit 16, a resistor $R_{14}$ is connected to the collector of transistor $Q_{13}$ and so determines the voltage applied to a transistor $Q_{14}$ when transistor $Q_{13}$ is on.

Fuel pump drive circuit 24 consists of transistors $Q_{14}$, $Q_{15}$ and a resistor $R_{15}$. When transistor $Q_{13}$ is turned on or off, transistor $Q_{14}$ is turned off or on in the polarity opposite that of transistor $Q_{13}$. Transistor $Q_{14}$ in turn switches a power transistor $Q_{15}$ in the opposite polarity. Therefore, power transistor $Q_{15}$ turns on and off essentially in synchronism with transistor $Q_{13}$. The time intervals during which power transistor $Q_{15}$ is on and off are determined by the duty cycle of the output of comparator 17, and determine the magnitude of the electrical current supplied to fuel pump 23. Since the rotational speed of pump 23 is controlled by the electrical current, the amount of fuel discharged from pump 23 is controlled in accordance with the operational state of the engine indicated by the detecting unit 11.

As is obvious from above, the employment of single triangular waveform generator 18 provides a simplified system structure which predominantly comprises transistors and resistors, thereby imparting enhanced reliance to the fuel pump control apparatus. Since the triangular waveform generator 18 uses a frequency outside the acoustical frequency range, the system does not interfere with audio devices such as radio receivers in the vehicle. In FIG. 1, $D_{11}$ denotes a protective diode for fuel pump 23.

Figure 3:
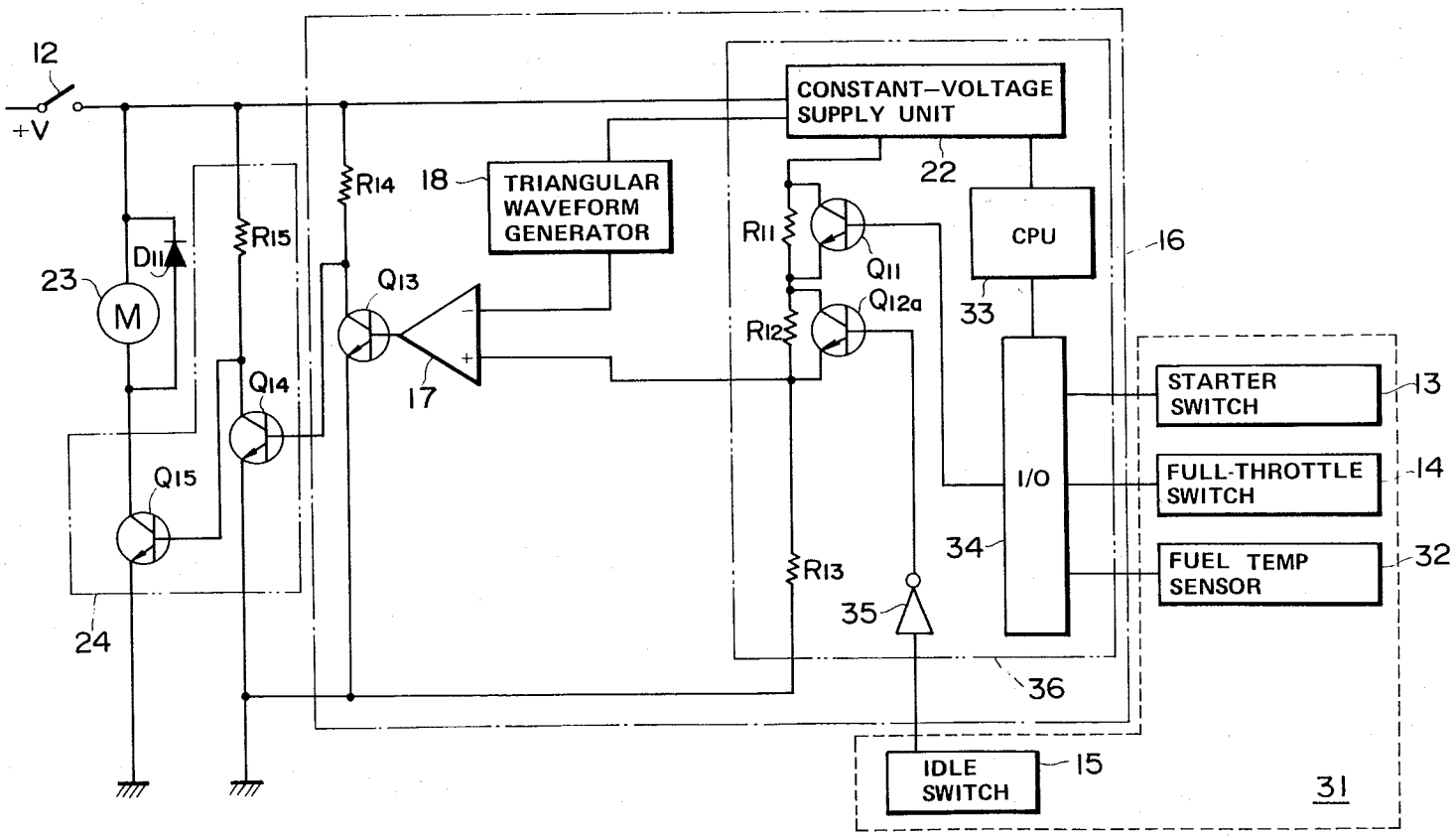
FIG. 3 is a schematic circuit diagram of a second embodiment of the fuel pump control apparatus according to the present invention.

Referring to FIG. 3, there is shown a second embodiment of the present invention. Basically, only those structural and operational features of this embodiment different from those of FIG. 1 will be described. Operational-state detecting unit 31 includes, in addition to starter, full-throttle and idle switches 13, 14 and 15, a fuel temperature sensor 32 which senses the temperature of fuel in the engine and produces an ON signal when the fuel temperature is above a predetermined value. When CPU 33 receives an ON signal from either of switches 13 or 14 or from sensor 32, it outputs a high-level voltage signal via I/O 34 to the base of transistor $Q_{11}$. Idle switch 15 alone is connected via an inverter 35 to the base of a transistor $Q_{12a}$ which is not connected to I/O 34.

The on and off conditions of transistors $Q_{11}$ and $Q_{12a}$ and the plus-input terminal voltage of comparator 17 are illustrated in Table II:

TABLE II

| MODE | IDLE SWITCH 15 | TRANSISTOR $Q_{12a}$ | I/O | TRANSISTOR $Q_{11}$ | PLUS TERMINAL VOLTAGE OF COMPARATOR 17 |
|---|---|---|---|---|---|
| II-1 | OFF | ON | ON | ON | Vcc |
| II-2 | ON | OFF | ON | ON | $\frac{R_{13}}{R_{12}+R_{13}} \times Vcc$ |
| II-3 | OFF | ON | OFF | OFF | $\frac{R_{13}}{R_{11}+R_{13}} \times Vcc$ |
| II-4 | ON | OFF | OFF | OFF | $\frac{R_{13}}{R_{11}+R_{12}+R_{13}} \times Vcc$ |

As apparent from this Table II, the comparison or plus-input terminal voltage of comparator 17 changes in four steps corresponding to modes (II-1, -2, -3 and -4), enabling more accurate control of fuel pump 23. Comparison of the conditions in idling modes (II-2) and (II-4) shows that the comparison voltage will be latched to the mode (II-4) value until the temperature of fuel reaches a predetermined value during idling, thereby holding the rotational speed of fuel pump 23 to a low value. This prevents unnecessary energy consumption and noise due to the operation of fuel pump 23. CPU 33, I/O 34, constant-voltage supply unit 22, transistors $Q_{11}$, $Q_{12a}$, resistors $R_{11}$, $R_{12}$ and $R_{13}$, and inverter 35 constitute the comparison voltage calculating unit 36.

Figure 4:
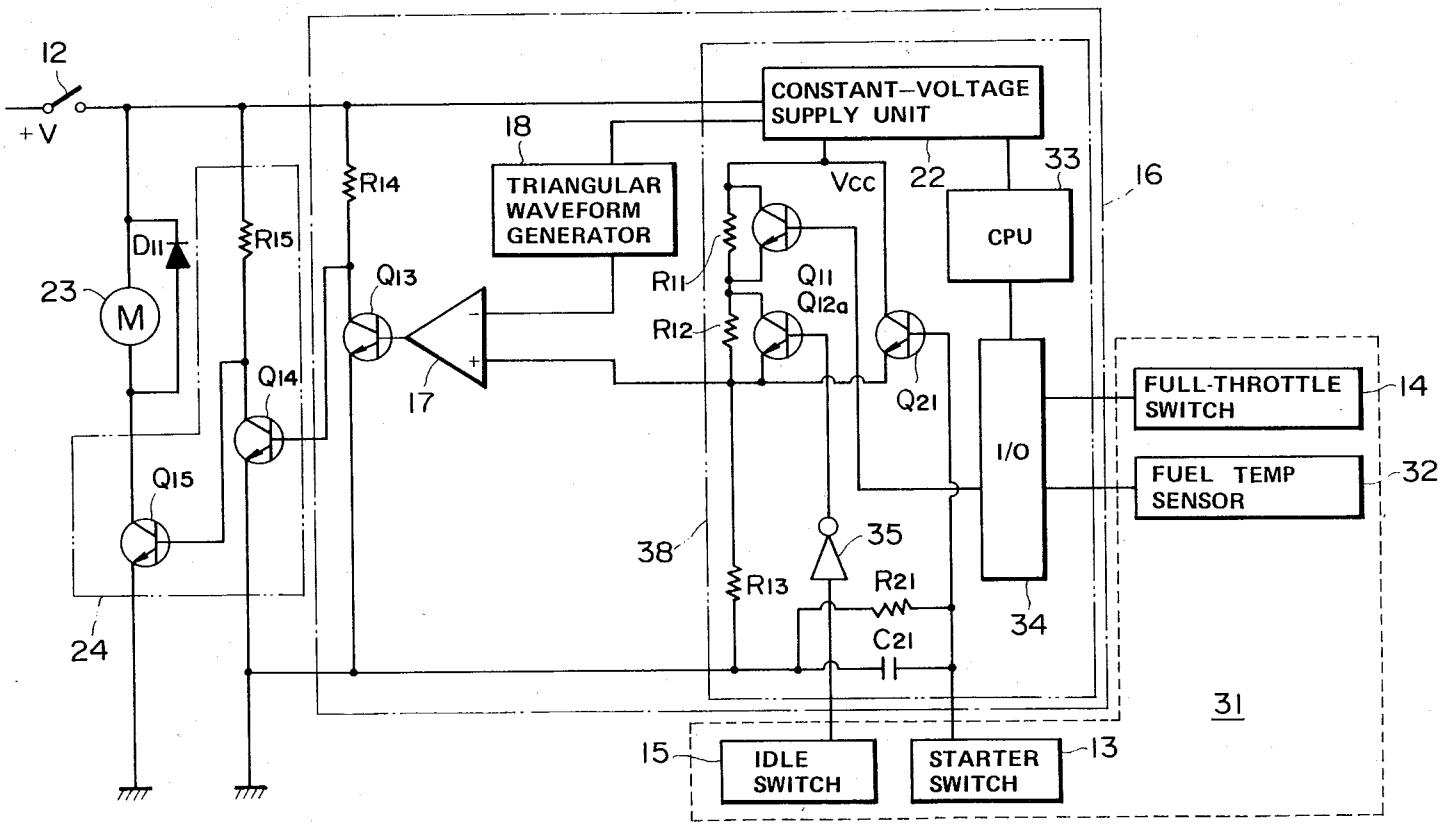
FIG. 4 is a diagram similar to FIG. 3 of a third embodiment of the present invention.

Referring to FIG. 4, there is shown a third embodiment of the present invention. This embodiment has the additional feature of maximizing the comparison voltage when the starter switch is on. The structural and operational feature of this embodiment differing from the second embodiment will be described. In FIG. 4, starter switch 13 is connected to the base terminal of a transistor $Q_{21}$, rather than to I/O unit 34, so that when it is turned on, the transistor $Q_{21}$ is turned on to connect the output voltage Vcc of constant-voltage unit 22 to the plus-input terminal of comparator 17. When starter switch 13 is turned off, transistor $Q_{21}$ remains on for a predetermined time determined by an RC circuit which consists of a resistor $R_{21}$ and a capacitor $C_{21}$ connected in parallel between the output of starter switch 13 and ground. The additional components of comparison voltage computing unit 36 are transistor $Q_{21}$, resistor $R_{21}$ and capacitor $C_{21}$. As described above, during cranking, the comparison voltage of comparator 17 is always as a maximum level Vcc so that the rotational speed of fuel pump 23 is also maximized. When the engine changes from cranking to idling, the rotational speed of fuel pump 23 drops gradually due to the time constant of the RC circuit. As a result, even if fuel pump 23 experiences vapor lock when engine is being restarted while hot, fuel pump 23 can provide sufficient fuel discharge to start the engine smoothly.

Figure 5:
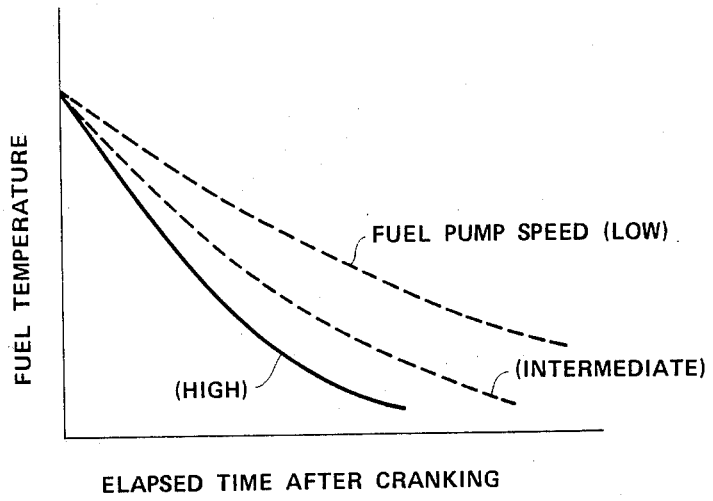
FIG. 5 is a graph of the relationship between time after cranking, fuel temperature and fuel pump speed in the embodiment of FIG. 4.

In more detail, the temperature of fuel in the vicinity of the fuel injection nozzle is related to the time after cranking and the rotational speed of fuel pump 23 as shown in FIG. 5. This derives from the fact that when fuel pump 23 discharges a great deal of fuel, the fuel in the vicinity of the fuel injection nozzle is quickly returned to the fuel tank and replaced with the low-temperature fuel from the fuel tank. As obvious from the above, when starter switch 13 is turned on, fuel pump 23 is driven at full speed so that fuel pump 23 can be reduced in size thanks to its increasedly efficient operation.

Figure 6:
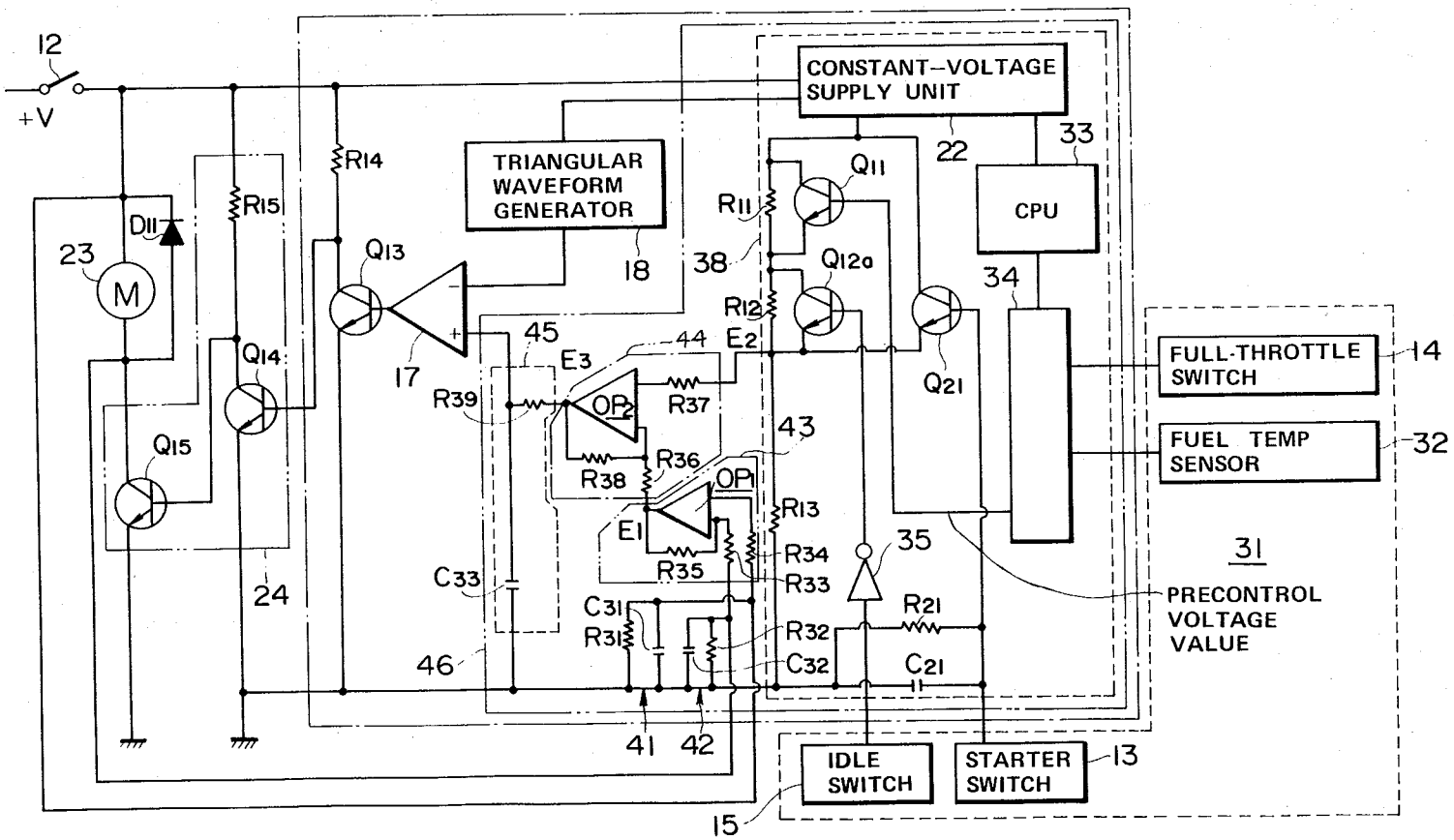
FIG. 6 is a diagram similar to FIG. 4 of a fourth embodiment of the present invention.

Referring to FIG. 6, there is shown a fourth embodiment of the present invention which by means of feedback of the voltage across the fuel pump furthers improves the accuracy with which the rotational speed of fuel pump can be controlled. In this embodiment, only the structural and operational features of the system different from the above embodiments will be described. The respective terminal voltages of fuel pump 23 are integrated by an integrating circuit 41 consisting of a resistor $R_{31}$ and a capacitor $C_{31}$, and an integrating circuit 42 consisting of a resistor $R_{32}$ and a capacitor $C_{32}$ and are then inputted to a differential amplifying circuit 43 which consists of resistors $R_{33}$, $R_{34}$ and $R_{35}$ and an operational amplifier $OP_1$. The difference between the respective input voltages to amplifiers $OP_1$ i.e., the difference between the integrated terminal voltages of fuel pump 23 is converted to a dc voltage corresponding to the cross-over voltage, or slice level, of comparator 17 and outputted to differential amplifying circuit 44. Differential amplifying circuit 44 consists of resistors $R_{36}$, $R_{37}$ and $R_{38}$ and an operational amplifier $OP_2$. Differential amplifying circuit 44 outputs a signal indicative of the output voltage $E_2$ of comparison voltage computing unit 38 plus an amplification term corresponding to the difference between the output $E_2$ of comparison voltage computing unit 38 and the output $E_1$ of differential amplifying circuit 43. The output signal $E_3$ of differential amplifying circuit 44 is given by:

$$E_3 = E_2 + (E_2 - E_1)\alpha \quad (1)$$

where $\alpha = R_{38}/R_{36}$ is the amplification factor of differential amplifying circuit 44. An integrator 45, consisting of a resistor $R_{39}$ and a capacitor $C_{33}$, integrates the output signal of differential amplifier 44 and outputs the integrated voltage as the comparison voltage to comparator 17. Comparison voltage computing unit 38, integrators 41 and 42, differential amplifying circuits 43, 44 and integrator 45 together constitute a comparison voltage computing circuit 46.

Figure 7:
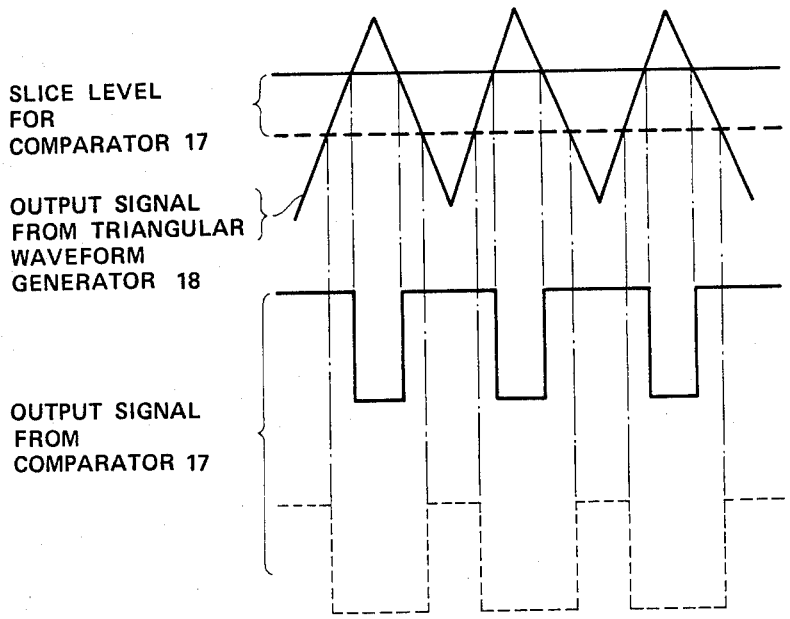
FIG. 7 is a timing chart similar to FIG. 2, concerning the corresponding elements of the apparatus of FIG. 6.

Thus, in this particular embodiment, when the terminal voltages of fuel pump 23 are high and the output signal of differential amplifying circuit 43, which depends on the terminal voltages, is higher than the output voltage of computing unit 38, the output voltage of differential amplifying circuit 44 is the output voltage of comparison voltage computing unit 38 less a voltage proportional to the difference between the output voltage of comparison voltage computing unit 38 and differential amplifying circuit 43. This is because the second item of equation (1) is a negative value. Thus, when the output voltage of differential amplifying circuit 44 drops, the charge on a capacitor $C_{33}$ of integrator 45 decreases so that the comparison voltage or slice level of comparator 17 drops, as shown in FIG. 7. The time during which power transistor $Q_{15}$ is rendered conductive decreases so that the discharge of fuel from fuel pump 23 decreases. On the other hand, when the difference between the terminal voltages of fuel pump 23 is low and the voltage outputted from differential amplifying circuit 43 to differential amplifying circuit 44 is lower than the voltage outputted from comparison voltage calculating unit 38 to differential amplifying circuit 44, the output voltage of differential amplifying circuit 44 is the output voltage of comparison voltage computing unit 38 plus a voltage proportional to the difference between the output of differential amplifying circuit 43 and the output of computing unit 38 so that the slice level of comparator 17 increases. The time during which power transistor $Q_{15}$ is rendered conductive increases and the discharge of fuel from fuel pump 23 increases. As obvious from above, the feedback of the terminal voltage of fuel pump 23 to control the comparison voltage or slice level to comparator 17 causes the supply of electrical current to fuel pump 23 to be controlled with higher precision without being affected adversely by possible manufacturing errors in the pump components.

Figure 8:
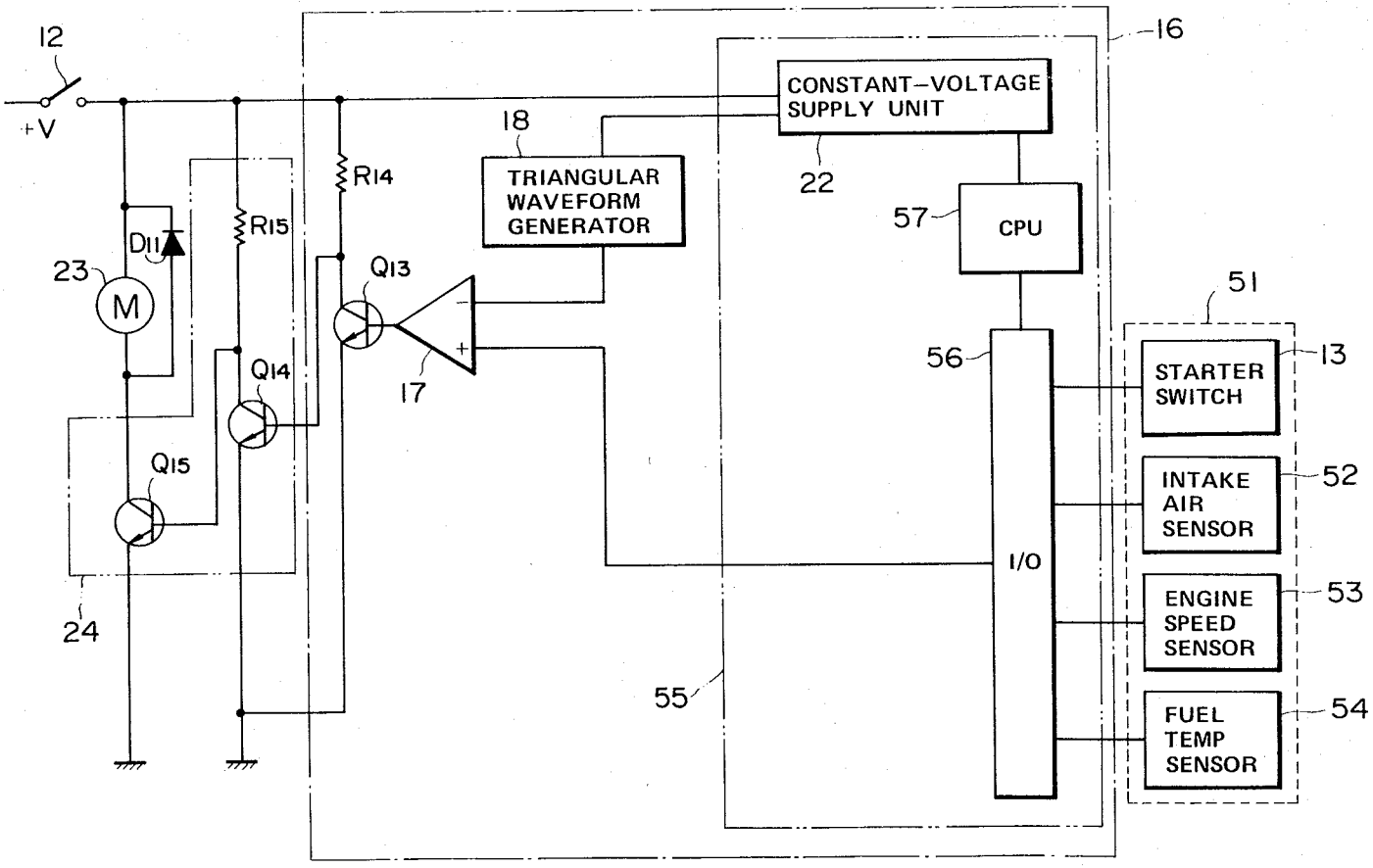
FIG. 8 is a diagram similar to FIG. 4 of a fifth embodiment of the present invention.
Figure 9:
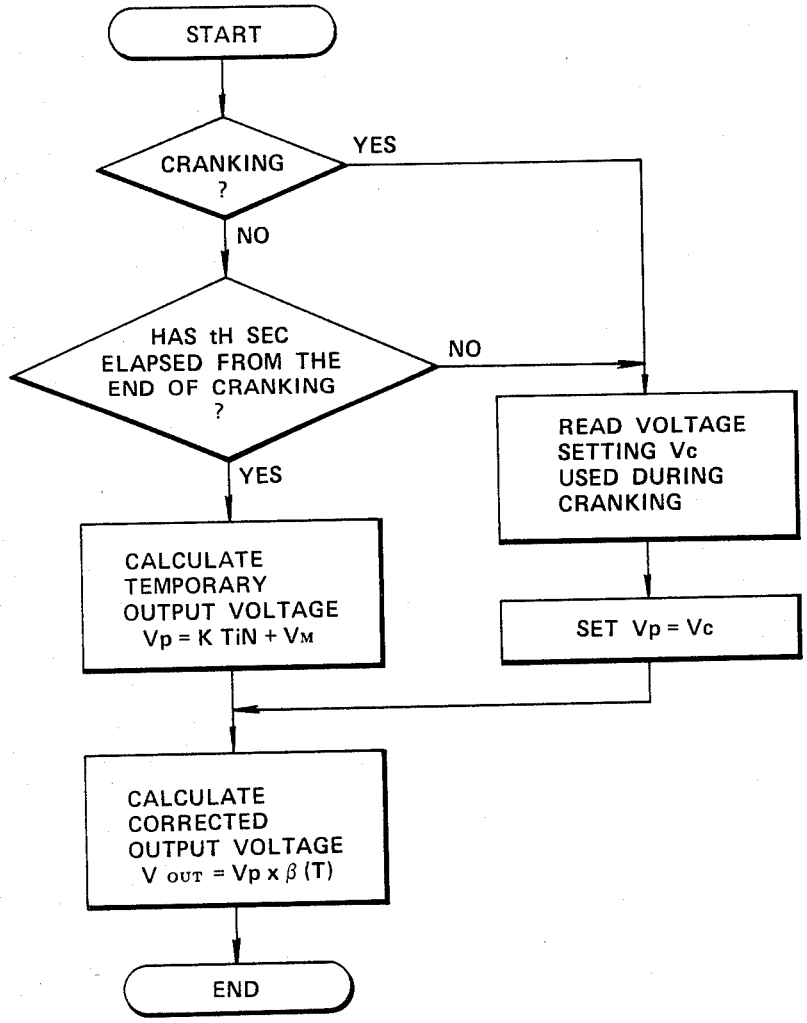
FIG. 9 is a flowchart of the operation of the CPU in the fifth embodiment of FIG. 8.
Figure 10:
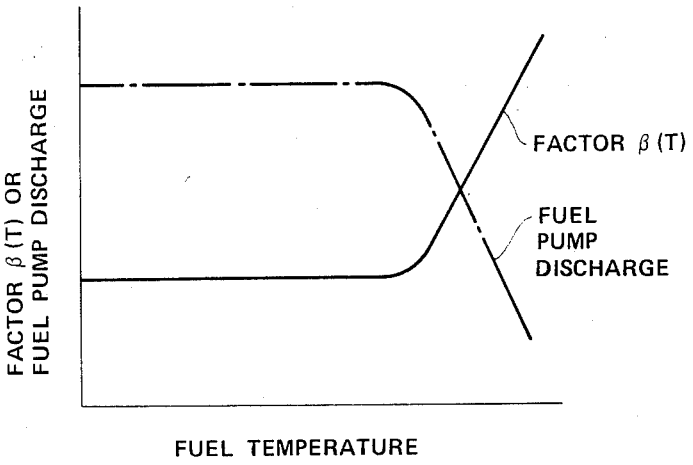
FIG. 10 is a graph of the relationship between fuel temperature, fuel pump discharge, and a computational factor used to correct the fuel pump discharge in the fifth embodiment.

Referring to FIG. 8, there is shown a fifth embodiment of the present invention. Again, only the structural and operational features differing from the previously described embodiments will be described. Reference numeral 51 denotes an operating-state sensing unit which has starter switch 13, an intake air quantity sensor 52, an engine speed sensor 53 and a fuel temperature sensor 54. Intake air quantity sensor 52, which may be an air flowmeter, senses the amount of air drawn into the engine. Engine speed sensor, which may be a crankshaft rotation sensor, senses engine speed. Fuel temperature sensor 54 senses the temperature of fuel present in the vicinity of the fuel injector nozzle. Reference numeral 55 is a comparison voltage computing unit, which has an I/O circuit 56, a CPU 57 and a constant-voltage supply unit 22, calculates the comparison voltage or slice level of comparator 17 from engine conditions and fuel temperature indicated by the signals from operating-state sensor 51. That is, CPU 57 calculates an output voltage signal on the basis of the signals from sensor unit 51 in accordance with a flowchart shown in FIG. 9. First, CPU 57 determines whether or not the engine is cranking by reference to the ON or OFF condition of the signal from starter switch 13. If the engine is cranking, the CPU reads a voltage setting Vc, equal to the activation voltage of transistor $Q_{13}$ stored previously in the ROM of CPU 57. The voltage setting value Vc is converted to a corresponding temporary output voltage Vp. The temporary output voltage Vp is adjusted in accordance with the output signal from fuel temperature sensor 54 to produce a corrected output voltage Vout which is supplied via I/O 56 to comparator 17. The discharge of fuel from pump 23 decreases as shown by the phantom line in FIG. 10 as the temperature of fuel T increases. CPU 57 performs the correction for fuel temperature T by reading a desired factor $\beta(T)$ from data held in a ROM of CPU 57 representing the $\beta(T)$ curve, shown in solid line, which is the inverse of the fuel temperature/discharge curve shown in phantom lines in FIG. 10 in accordance with the temperature sensor 54 output signal from a ROM of CPU 57, and that the read factor is multiplied by the temporary output voltage Vp. That is, the corrected output voltage Vout is given by:

$$Vout = Vp \times \beta(T) \quad (2).$$

The reason why the fuel discharge from fuel pump 23 changes with fuel temperature T is that when fuel temperature T rises, the vapor pressure of the fuel increases and the viscosity of the fuel drops.

Figure 11:
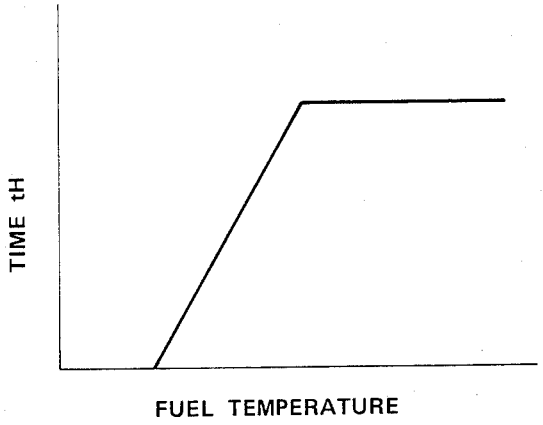
FIG. 11 is a graph of the relationship of fuel temperature to time during which the maximum output voltage is maintained after cranking in the apparatus of FIG. 8.

When the engine is not cranking, it is determined whether or not a predetermined time $t_H$ has passed since the end of cranking. If the predetermined time has not passed, CPU 57 reads the voltage setting Vc used during cranking. The predetermined time ($t_H$) is in units of seconds given as a function of the fuel temperature as shown in FIG. 11 and is read from the ROM of CPU 57 on the basis of the signal from fuel sensor 54. The reason why the CPU reads the voltage setting Vc used during cranking when the predetermined time has not passed since the end of cranking is to improve the stability of engine operation after restart. In other words, when fuel temperature is high immediately after restart, fuel is likely to vaporize. In that case, hunting or engine stalling is likely to occur if fuel pump 23 does not provide sufficient fuel discharge.

When predetermined time $T_H$ has elapsed since the end of cranking, CPU 57 calculates a temporary output voltage Vp for comparator 17 on the basis of measured engine conditions. Particularly, first, the width of a fuel injection pulse, Ti, is calculated on the basis of the signals from the engine speed sensor 53 and the intake air sensor 52 in accordance with the following equation:

$$Ti = k(Q/N)$$

where k is a constant, Q denotes the amount of intake air, and N denotes engine speed (rpm). The rate of fuel flow $F_A$ required by the engine is calculated on the basis of injection pulse width Ti and the signal from engine speed sensor 53 by the following equation:

$$F_A = k \cdot Ti \cdot N.$$

Figure 12:
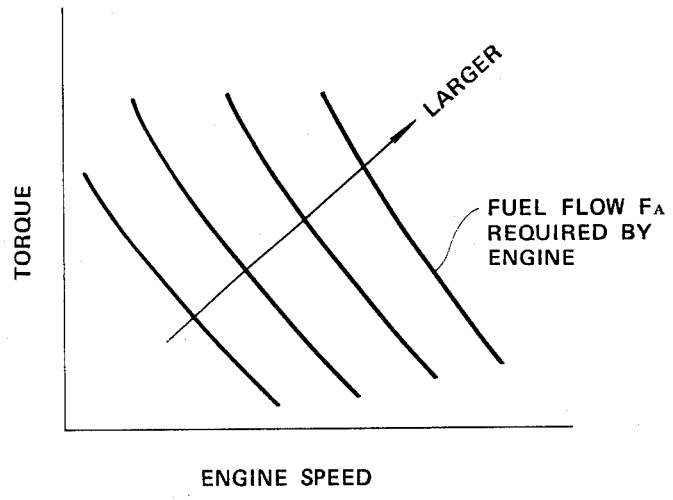
FIG. 12 is a graph of the relationship of fuel quantity required by the engine, engine speed, and engine output torque in the apparatus of FIG. 8.

This is due to the fact that the rate of fuel flow $F_A$ required by the engine is related to engine speed N and torque T such as shown in FIG. 12. The temporary output voltage $V_p$ corresponding to fuel flow rate $F_A$ plus a margin value $V_M$ can be calculated by the following equation:

$$Vp = V_A + V_M = kTiN + V_M.$$

Margin $V_M$ is determined in consideration of the transitional performance of fuel pump 23, the pressure loss in the fuel pipeline and irregularities in the fuel pump performance characteristics. Thus, the temporary output voltage Vp serves to continuously set the comparison voltage of comparison 17 so that fuel pump 23 constantly outputs a sufficient amount of fuel in accordance with engine conditions. The temporary output voltage Vp is adjusted on the basis of fuel temperature in accordance with equation (2) and the adjusted output voltage Vout is outputted to comparator 17. The voltage Vout continuously controls the comparison voltage or slice level of comparator 17.

As is obvious from the above embodiments, fuel pump 23 is set to deliver a maximum amount of fuel during cranking or within a predetermined time $T_H$ after the end of cranking. During predetermined time $T_H$, which may be a function of the fuel temperature, fuel pump 23 can be set so as to produce a maximum output, thereby rapidly lowering the temperature of excessively hot fuel in the vicinity of the fuel injector nozzle. Thus, the startup or restartup of the engine and stable operation of engine immediately after startup are improved. The output of fuel pump 23 can be adjusted in consideration of the fact that fuel pump 23 is affected by the temperature of fuel so that the appropriate amount of fuel is supplied to the engine. The comparison voltage of comparator 17 can be adjusted continuously so that fuel pump 23 is controlled with high precision. Accordingly, the rotational speed of fuel pump 23 can always be held at the lowest level sufficient to ensure fuel flow satisfying the requirements of the engine, so that power consumption and noise due to pump operation are decreased to a minimum.

While several preferred embodiments of the present invention have been described and shown, it should be noted that the present invention is not limited to them. Various changes and modifications could be made by those skilled in the art without departing from the scope of the present invention as set forth in the attached claims.

What is claimed is:

1. Apparatus for control of a fuel pump for an internal combustion engine of a vehicle, comprising:

means for sensing the operating state of the engine to produce a state signal indicative thereof;

means for computing an optimal precontrol voltage value in accordance with the state signal;

at least two series connected resistors connected between a source of voltage and ground;

means responsive to the optimal precontrol voltage value for short-circuiting at least one of said resistors in order to produce the comparison signal;

means for generating a reference signal having a predetermined frequency and waveform;

means for comparing the comparison signal to the reference signal to produce a control pulse, the width of which is equal to the interval during which the magnitude of the comparison signal exceeds that of the reference signal; and means for driving the fuel pump in accordance with the control pulse.

2. The apparatus of claim 1, wherein said sensing means includes a starter switch for sensing whether an ignition switch is in a start position to produce a starter switch signal when the ignition switch is in the start position, a full-throttle switch for sensing whether the intake manifold vacuum is below a predetermined vacuum value to produce a full-throttle switch signal when the intake manifold vacuum is below the predetermined vacuum value, means for sensing whether the temperature of fuel is above a predetermined temperature value to output a fuel temperature signal when the temperature of fuel is above the predetermined temperature value, said precontrol voltage computing means being responsive to said starter switch signal, said full-throttle switch signal and said fuel temperature signal for outputting a precontrol signal when at least one of said starter switch signal, said full-throttle switch signal and said fuel temperature is present, said short-circuiting means being responsive to said precontrol signal for short-circuiting a predetermined one of said resistors, and an idle switch for producing an idle switch signal during engine idling, said short-circuiting means short-circuiting a second predetermined one of said three resistors in accordance with the idle switch signal.

3. The apparatus of claim 1, wherein said sensing means includes a starter switch for sensing whether or not an ignition switch is in a start position to output a starter switch signal when the ignition switch is in the start position, and means for sensing the temperature of fuel to output a fuel temperature signal when the temperature of fuel is above a predetermined value, said short-circuiting means being responsive to said precontrol voltage value for short-circuiting a predetermined one of said resistors, an idle switch for producing an idle switch signal during engine idling, said short-circuiting means short-circuiting a second predetermined one of said resistors in accordance with the idle switch signal, and a starter switch for producing a starter switch signal during an engine starting operation, said short-circuiting means being responsive to the starter switch signal for short-circuiting both of said first-mentioned and second predetermined resistors.

4. The apparatus of claim 3, further including means for maintaining the short-circuiting of both said first-mentioned and second predetermined resistors for a predetermined interval of time after the end of the starting operation.

5. The apparatus of claim 3, further including means provided between said resistors and said comparing means for feedback-controlling the pump, said feedback-controlling means including means for converting the voltage across said pump to an equivalent voltage signal, means for amplifying differentially the equivalent voltage signal and the comparison signal, and means for integrating the output of said differential amplifying means.

6. Apparatus for control of a fuel pump for an internal combustion engine of a vehicle, comprising:

means for sensing the operating state of the engine to produce a state signal indicative thereof;

means for determining a comparison signal in accordance with the state signal and outputting the comparison signal;

means for generating a reference signal having a predetermined frequency and waveform;

means for comparing the comparison signal to the reference signal to produce a control pulse coinciding with the interval during which the magnitude of the comparison signal exceeds that of the reference signal; and means for driving the fuel pump in accordance with the control pulse, wherein said sensing means includes a starter switch for sensing whether or not an ignition switch is in a start position to produce an ON signal when the ignition switch is in the start position, and an OFF signal otherwise, means for sensing the quantity of intake air drawn into the internal combustion engine to output an intake air signal indicative of the quantity of intake air, means for sensing the speed of said engine to output a speed signal indicative of engine speed and means for sensing the temperature of fuel supplied to said engine to output a fuel temperature signal indicative of the fuel temperature; and wherein said determining means determines whether or not the internal combustion engine is cranking depending on the signal from said starter switch, reads a voltage value set corresponding to cranking when the engine is cranking, determines whether or not a predetermined time has elapsed since the end of cranking when the engine is not cranking, reads said set voltage value when the predetermined time has not elapsed, calculates a fuel injection pulse width in accordance with the signals from said engine speed sensing means and said intake air quantity sensing means when the predetermined time has elapsed since the end of cranking, calculates a voltage value representing the quantity of fuel required by said engine in accordance with the calculated width of the fuel injection pulse and the signal from said engine speed sensing means, and corrects the voltage value in accordance with the signal from said fuel temperature sensing means to output the comparison signal, in order to compensate for a decrease in the rate of fuel discharge from said fuel pump as the fuel temperature increases.

7. The apparatus of claim 6, wherein the predetermined time is a function of the fuel temperature.

8. The apparatus of claim 6, wherein the comparison signal includes a term for compensating for the transitional performance of said fuel pump, pressure loss occurring during flow of fuel through fuel lines and the performance characteristics of said fuel pump.

9. The apparatus of claim 1, wherein said reference signal generating means produces a triangular waveform signal.

10. The apparatus of claim 2, wherein said reference signal generating means produces a triangular waveform signal.

11. The apparatus of claim 3, wherein said reference signal generating means produces a triangular waveform signal.

12. The apparatus of claim 6, wherein said reference signal generating means produces a triangular waveform signal.

13. Apparatus for control of a fuel pump for an internal combustion engine of a vehicle, comprising:

means for sensing the operating state of the engine to produce a state signal indicative thereof;

means for computing an optimal precontrol voltage value in accordance with the state signal;

means for providing a comparison signal having a constant magnitude;

means for adjusting the magnitude of the comparison signal in accordance with the precontrol voltage value;

means for generating a reference signal having a predetermined frequency and waveform; and means for comparing the adjusted magnitude of the comparison signal to the magnitude of the reference signal to produce a control pulse, the width of which is equal to the interval during which the magnitude of the comparison signal exceeds that of the reference signal, whereby the control pulse controls the fuel pump.

14. The apparatus according to claim 13, wherein said comparison signal providing means includes a plurality of series connected resistors for passing therethrough said comparison signal, and said adjusting means includes means for short-circuiting a predetermined one or more of said resistors in accordance with the precontrol voltage value.

15. The apparatus according to claim 14, wherein said short-circuiting means includes a plurality of transistors.

16. The apparatus according to claim 13, wherein said reference signal is a periodical triangular waveform signal.

17. Apparatus for control of a fuel pump for an internal combustion engine of a vehicle, comprising:

(a) start detection means for producing an ON signal when an ignition switch is in the start position and an OFF signal otherwise;

(b) an intake air quantity sensing means for outputting an intake air signal indicative of a quantity of intake air drawn into said engine;

(c) an engine speed sensing means for outputting a speed signal indicative of engine speed;

(d) a computer means operable for determining whether or not said engine is cranking on the basis of the signal from said start detection means, for determining whether or not a predetermined time has elapsed since the end of cranking, for reading a predetermined set voltage value when said engine is cranking or when the predetermined time has not elapsed since the end of cranking and for outputting the read voltage as a comparison signal, for calculating a second voltage value on the basis of the engine speed signal and the intake air signal after the predetermined time has elapsed since the end of cranking and for outputting the second voltage as a comparison signal;

(e) means for producing a reference signal having a predetermined frequency and waveform; and (f) means for comparing the comparison signal to the reference signal and for producing a control pulse signal, the width of each of the pulses of the pulse signal coinciding with the interval during which the magnitude of the comparison signal exceeds that of the reference signal, whereby the control pulse signal controls said fuel pump.

18. The apparatus according to claim 17, further including means for outputting a fuel temperature signal indicative of the temperature of fuel supplied to said engine, and wherein said comparison signal is corrected in accordance with the fuel temperature signal.

* * * * *